United States Patent [19]

Engelbrecht

[11] 4,071,079

[45] Jan. 31, 1978

[54] HEAT-STORAGE UNIT AND SYSTEM

[75] Inventor: Hans Engelbrecht, Siegen-Eisern, Germany

[73] Assignee: Sadao Shimoda, Kamagaya, Japan

[21] Appl. No.: 596,106

[22] Filed: July 16, 1975

[30] Foreign Application Priority Data

| | | |
|---|---|---|
| July 31, 1974 | Australia | 71882/74 |
| Oct. 23, 1974 | Australia | 74621/74 |

[51] Int. Cl.[2] ..... F25B 29/00; F24H 7/00; F22B 1/02; H05B 1/00

[52] U.S. Cl. ..... 165/48; 60/659; 122/40; 122/32; 126/400; 165/104 S; 165/105; 219/273; 219/325; 219/378

[58] Field of Search ..... 219/530, 540, 430, 439, 219/365, 378, 325, 326, 302, 271-276; 60/659; 122/32, 33, 40; 165/104 R, 104 M, 104 S, 105, 18, 48, 2, 58; 126/400

[56] References Cited

FOREIGN PATENT DOCUMENTS

| | | | |
|---|---|---|---|
| 2,039,586 | 8/1971 | Germany | 219/326 |
| 2,013,565 | 10/1970 | Germany | 126/400 |
| 2,345,244 | 3/1975 | Germany | 219/325 |
| 1,323,522 | 7/1973 | United Kingdom | 219/325 |

*Primary Examiner*—A. Bartis
*Attorney, Agent, or Firm*—Charles E. Pfund

[57] ABSTRACT

A heat storage unit using salt or a salt mixture. Heat is extracted from the unit by converting water to steam and a series of pipes is provided extending to different depths in the salt. The pipes extend to different heights at the top of the unit so that water first overflows into the pipe extending the shortest distance into the salt. This results in the salt in the unit solidifying from the top downwards, thereby obviating problems caused by molten salt migrating to spaces at the foot of the container caused by contraction of salt on solidification. A heating system uses several such units with electrical heating between the units and pumped circulation of the condensate from the generated steam. An alternative system uses steam generated in such units selectively to drive a turbine for refrigeration equipment in a cooling system or to heat the heat exchange medium in a heating system.

9 Claims, 8 Drawing Figures

HEAT-STORAGE UNIT AND SYSTEM

BACKGROUND OF THE INVENTION

This invention relates to an off-peak, electrically heated, heat storage system, particularly for stored heating plants. This system includes a storage container to accommodate the salt used as a heat accumulator medium, an evaporator to generate steam, a heat-exchanger and a condenser installed in series.

Heat storage systems or accumulators are known and are used for utilizing cheap off-peak electrical energy for the production of heat which is required at a later time. Various types of construction have been used for storage heaters which have, however, not been completely successful in practice. Problems have arisen particularly with heat accumulators which use fusible salts as the accumulator medium.

Fusible, that is to say meltable, salts are particularly useful as the accumulator medium; for the heat accumulation is due not only to the specific heat, but also to the latent heat of fusion. Thus more heat can be accumulated for the same volume of the storage medium. Heat accumulators of this type, therefore, require only a relatively small space.

The repeated cycling between solid and liquid states during operation causes difficulties. Due to the different expansion coefficients of the container material and the solidified salt, stresses can occur to such an extent that the container can be destroyed. A further difficulty is the even extraction of heat from the heated salt. Whilst the heat-transfer from the liquid salt to the evaporator-system is very good, the heat-transfer from the solidified salt is not, because of the poor thermal conductivity of the salt. These problems can only be solved by an appropriate design of the evaporator system.

In the West-German Patent Specification No. 2,039,586 a heat accumulator is described which uses a fusible salt as the accumulator medium. The salt is stored in the container and is heated directly by heating elements immersed in the salt. A cylindrical evaporator also is located in the container, into which water is injected to produce steam. The water is fed to the evaporator through a pipe which is immersed in the lower part of the evaporator. Because of the heat extracted by the evaporating water the salt solidifies on the bottom of the container first.

The cavities, which result from the shrinking of the solid salt are filled from above by liquid salt, until the total salt content is completely solidified. Upon heating the compacted salt-core thus formed on the bottom of the container, stresses occur due to expansion of the solid salt, which lead to the deformation of the container casing.

Further, it is known that in air-conditioned buildings in summer the energy requirements for the refrigeration plants are higher than those in winter for heating. Cool air for buildings has to be produced during the day when a high demand for electricity exists. This load, which is above the output capacity of the power stations has resulted in some cases in the breakdown of the power supply. It is therefore very desirable to use off-peak electricity also for refrigeration.

Attempts have been made to solve this problem by special cold storage units. In these, water is used as a storage medium, which is cooled during the night and is used during the day in the cooling plant. Due to the low effective temperature gradient these storage units are large and therefore costly to construct. Further, it is a disadvantage that a cold storage unit is required in addition to a heat storage unit.

SUMMARY OF THE INVENTION

The present invention provides a heat storage unit which eliminates the above-mentioned disadvantages by providing an arrangement which permits the salt to solidify from the top to the bottom of the container. This is achieved by an evaporator system in the container which makes it possible to extract the heat from the liquid salt progressively from top to bottom, thus achieving a progressive solidification of the salt from top to bottom. Furthermore, the evaporator system is capable of extracting further heat from the solidified salt block despite its poor thermal conductivity.

The invention provides an arrangement of straight or U-bend evaporator pipes of different lengths, which are fixed to the top plate of the heat storage unit in such a way that the water for evaporation is fed into the shorter pipe first and flows into the next longer pipe only when most of the available heat has been extracted from the area around the shorter pipe.

A further characteristic of the invention is that the heat storage unit has a cylindrical container surrounded by a square case of cast iron. As a result, where space is limited, several heat accumulators can be arranged together in thermal communication to form a larger unit.

According to a further feature of the invention, a heat-exchanger is installed in series with the evaporator in the heat accumulator, through which the heat of the steam is transferred to the heating system. After the heat-exchanger an open condensate container is fitted which allows the condenser to be operated by atmospheric steam-pressure, thus eliminating the supervision necessary in a plant operating with steam at pressure. It is also possible to operate the plant in a vacuum steam mode by fitting a check-valve to the condensate container. With appropriate provisions, such as condensate drainage and a safety-valve, the plant can also be operated with steam pressure, as is sometimes necessary if higher steam temperatures are required. For example, a plant in a hospital can not only be used for heating or air-conditioning, but also for the preparation of steam for sterilization.

Further, the invention provides an economical method which makes it possible to utilize a heat storage unit also for the production of cold with a good efficiency. A particularly economical solution of the problem is to use the heat storage unit required for the winter also for cooling in the summer. In an electrically heated high temperature storage unit, a large quantity of energy can be stored in the form of heat in relatively little space. The heat for instance could be utilized in summer for running of absorption refrigeration units. Because of their low efficiency, however, absorption refrigeration units require approximately 2 Kcal (BTU) heat energy to produce 1 Kcal (BTU) cold energy, this method is uneconomical.

According to the invention, a high temperature storage unit is used as a heat accumulator which can produce steam at sufficient pressure to operate a steam turbine which drives the refrigeration unit.

DESCRIPTION OF THE PREFERRED EMBODIMENTS

Figure 1:
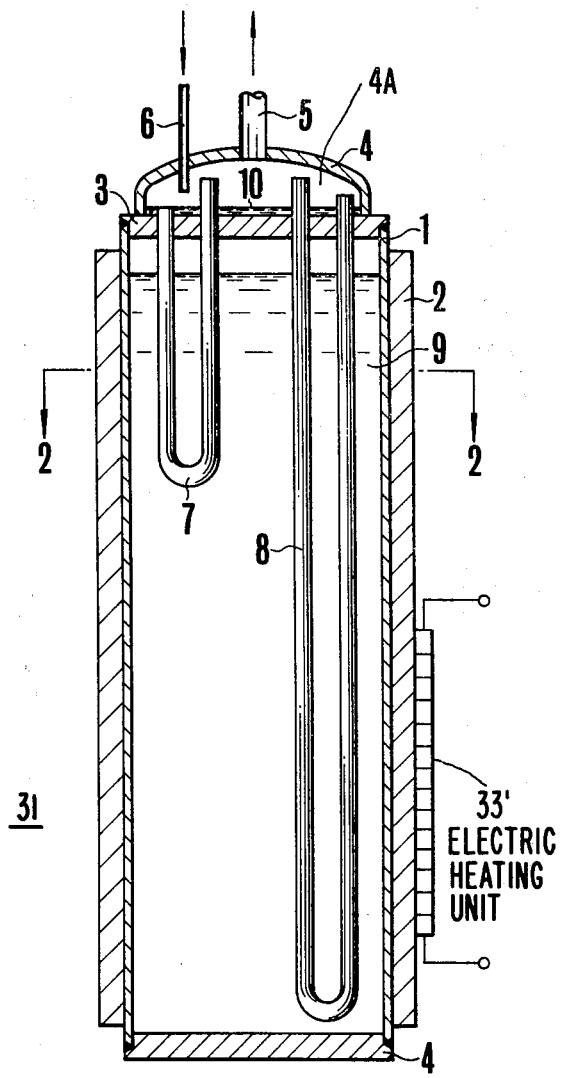
FIG. 1 is a longitudinal section of a heat-storage unit of this invention showing only one opposed pair of pipes.
Figure 2:
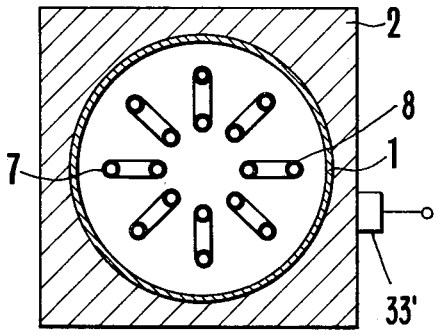
FIG. 2 is a cross-section taken along the line 2—2 of FIG. 1 showing four opposed pairs of pipes.

The heat accumulator 31 shown in FIGS. 1 and 2 consists of a steel container having a jacket 1, bottom 4 and container lid 3. Mounted on top of the container lid 3 and in communication with the heat storage medium 9 is a evaporator system generally designated 4A. Only one pair of opposed pipes 7, 8 is shown in FIG. 1 for clarity of illustration. The container is surrounded by a square cast iron block 2 and holds the heat storage medium, a meltable salt 9. In use a heat source is provided to supply heat as required and is shown, for example, as an electric heater 33' in FIG. 1 and FIG. 4. U-shaped pipes 7, 8 are fitted to the container lid 3 and are immersed into the salt to various depths. A vaulted lid 4 closes the evaporator system 4A at the top. Pipe 6 is the inlet pipe for the water to be evaporated and pipe 5 the steam outlet pipe.

Figure 3:
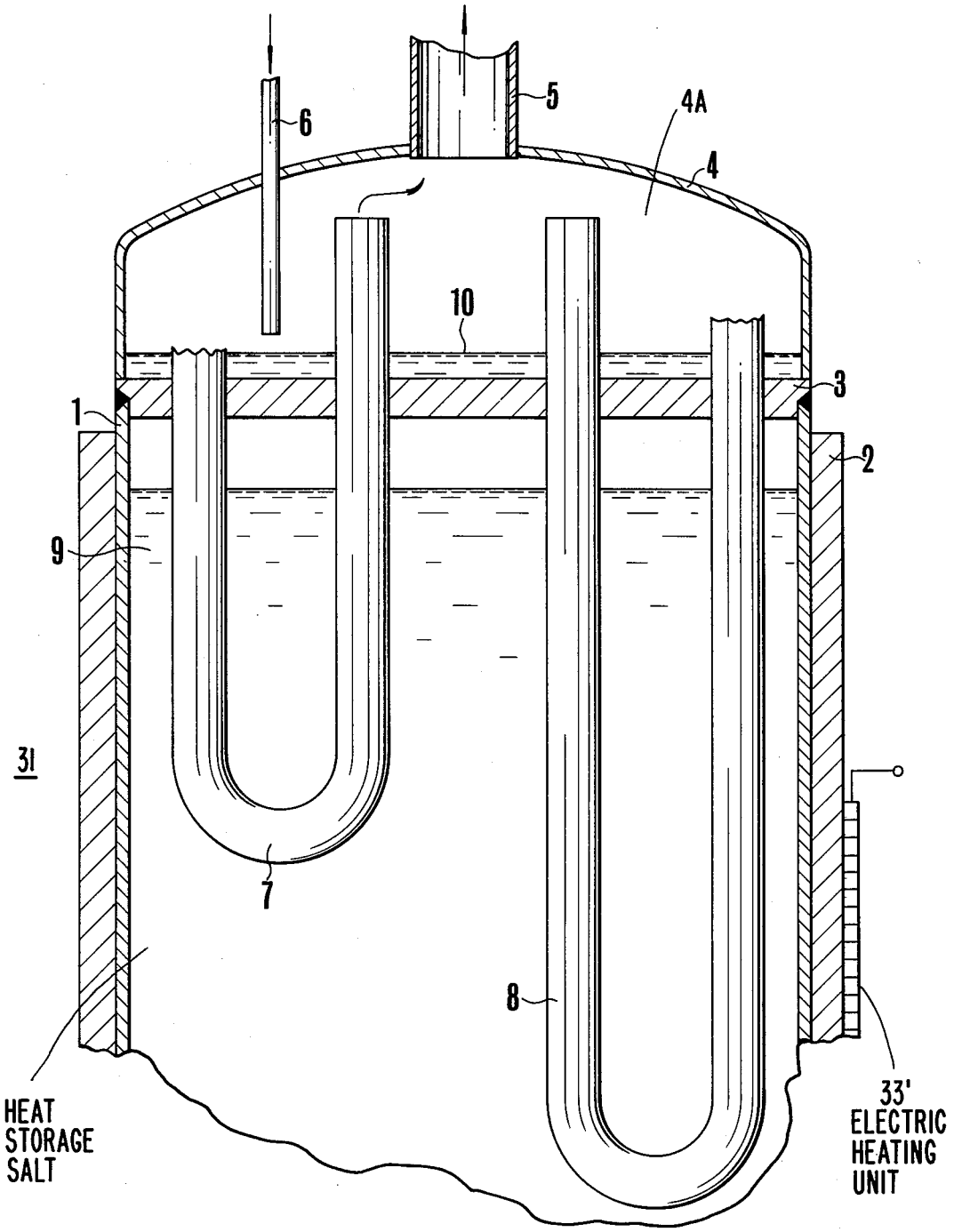
FIG. 3 is a longitudinal section of the heat-storage unit of FIG. 1 but on a larger scale still showing only one opposed pair of pipes.

FIG. 3 shows the design and the functioning of the evaporator system in more detail. It can be seen, that the shorter side of the shallower pipe 7 projects only slightly above the top surface of container lid 3. Water 10 fed in through pipe 6 flows first into pipe 7, whereby the resulting steam flows out through the longer leg of the U-shaped pipe and pipe 5. Consequently the heat is first extracted only from the top portion of the melted salt. Only after the top layer has solidified does the water level 1 rise to such an extent that it can flow into the deeper immersed pipe 8. The steam evaporation which occurs in this pipe leads to the solidification of the deeper lying salt layers.

The arrangement of two steps shown in the drawing is only exemplary and can, of course, be extended to three or more pipes, in which case the length of the immersed pipes is correspondingly arranged in sequence.

Figure 4:
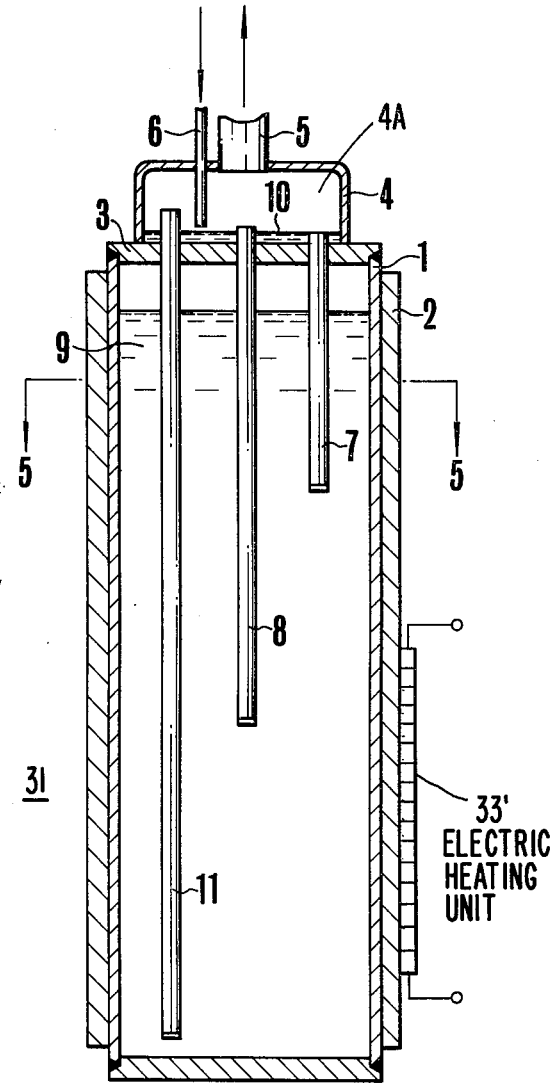
FIG. 4 is a longitudinal section of a heat-storage unit with a modified steam generating system.
Figure 5:
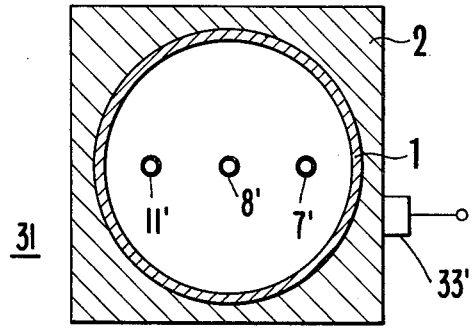
FIG. 5 is a cross-section taken along 4—4 of FIG. 4.

FIGS. 4 and 5 show a modified design of the evaporator system. This evaporator system consists of pipes of various lengths, 7', 8', 11, each closed at the foot. In this case the water flows first into the shorter pipe 7 and progressively into the next longer pipe 8 and then pipe 11 etc. As the steam inside the pipe rises against the incoming water, each pipe has only a certain maximum evaporation capacity, depending on the cross-section of the pipe. This is due to the rising steam above a certain volume preventing further inflow of water. This self-regulating effect providing a maximum vapourizing capacity is desirable in case of long, continuous discharges. If, however, at certain times, a greater volume of steam is required, the U-shaped pipes are preferred.

Figure 6:
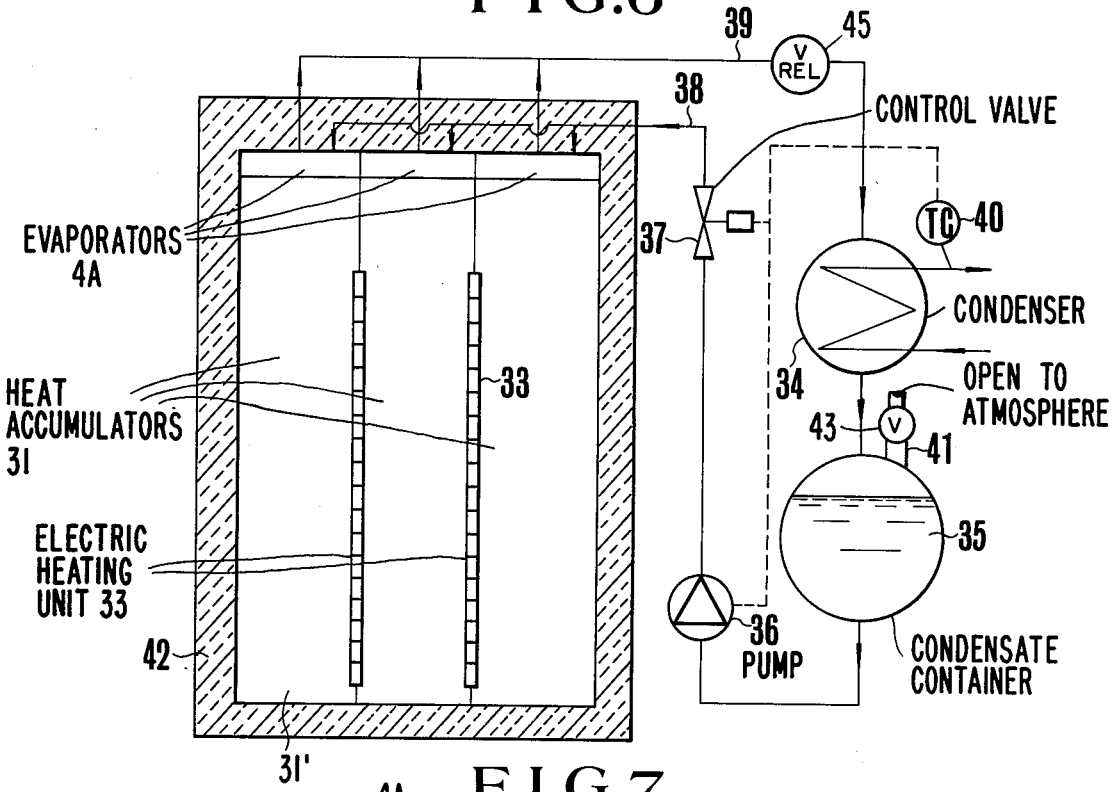
FIGS. 6 and 7 are schematic end and plan views of a heating plant using several heat-storage units.
Figure 7:
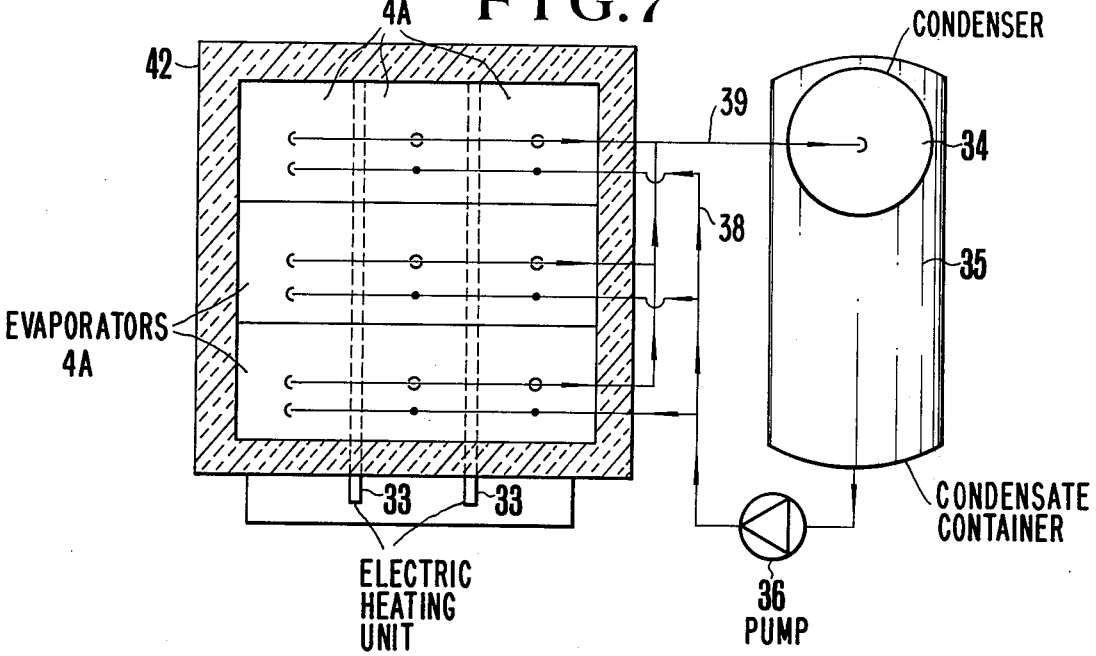

FIGS. 6 and 7 show schematically the construction of a storage heater plant, consisting of several (nine, as shown) heat accumulators 31 as described above. The accumulator units 31 with evaporator systems as shown in FIGS. 1–4 are assembled in one block, which is surrounded with thermal insulation 42. Heating is by electric heating units 33, which are fitted between the accumulator units.

After the accumulator is heated, condensate is fed from condensate container 33 into the evaporation system by a pump 36, through a pipe line 38 via a control valve 37. The steam goes through the pipe line 39 to the condenser 34. Here the condensed steam transfers its heat to the water of a heating system. The condensate then flows back to the container 35.

A temperature controller 40 releases the pump 36 when heat is required and opens a control valve 37. As soon as the preset pre-heating temperature is reached, the temperature controller switches the pump off and shuts the valve 37. The condensate container 35 is positioned with a tube 41 in connection with the atmosphere. The tube 41 can be fitted with a check valve 43 which only opens to the outside, thus creating a vacuum in the evaporator system. For operation with higher steam pressures, valve 43 is closed and the steam pipe 39 can be fitted with safety valve 45 and the condensate drained out of the heat exchanger by a condensate drain.

Figure 8:
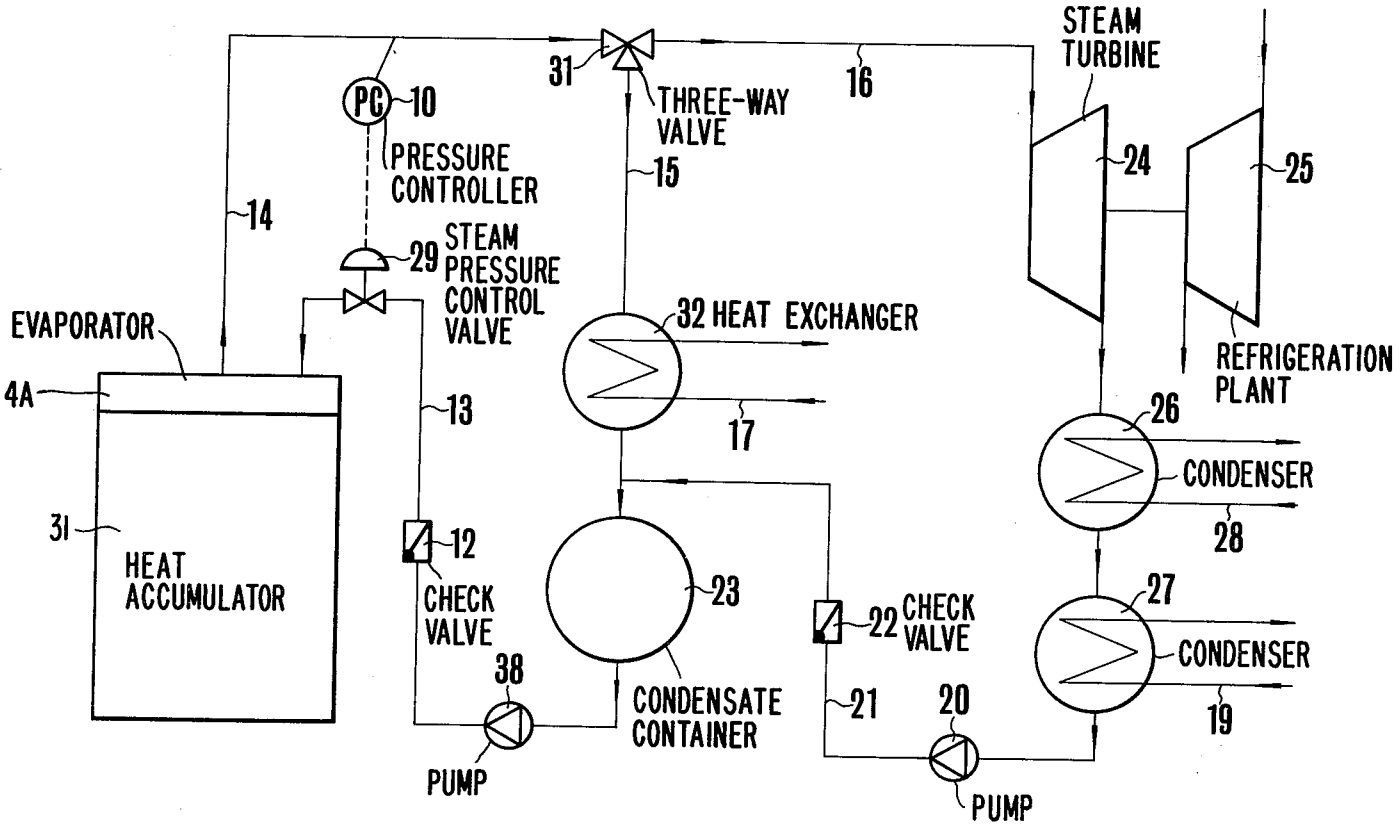
FIG. 8 is a schematic diagram of a cooling system using several of the heat storage units.

A unit for both heating and cooling is shown in FIG. 8 and consists of an electrically heated high-temperature heat storage unit 31, fitted with an evaporator for the production of steam as discussed above. The condensate used for the production of steam is conveyed by the pump 38 from the condensate container 23 through the pipe line 13 via a check valve 12 and a steam controlled pressure valve 29 into the evaporator of the heat storage unit 31.

During winter operation the steam flows via a three-way valve 31A through pipe line 15 into a heat exchanger 32 giving up its heat of condensation to a heating system 17. The condensate returns to a condensate container 23. During summer operation, the steam produced in the evaporator 4A flows via the three-way valve 31A through pipe line 16 into a steam turbine 24, which drives a refrigeration plant 25. The exhaust steam from the steam turbine 25 heats a hot water system 28 in a condenser 26 which is used for re-heating of the air in the air-re-heater of the air-conditioning plant. The remaining steam is condensed in a condenser 27 using the cooling water system 19 and this creates a vacuum in the steam system corresponding to the cooling water temperature. The condensate is fed by the pump 20 through a pipe line 21 via a check valve 22 into the condensate container 23.

The invention is not restricted to the examples shown in the attached drawings. Clearly, variations in the apparatus can be made without departing from the original concept of the invention.

I claim:

1. A heat accumulator unit comprising an accumulator medium comprising a salt, a container for said medium, means for supplying heat to the accumulator medium, a steam generator forming a part of said container and having a steam outlet adapted to be coupled to a heat utilization means, said generator including steam generating pipes of different lengths immersed to different depths into the salt, means for feeding water to the steam generator in predetermined quantities, including means for supplying the water inlets of the pipes by overflow, each pipe having a water inlet and a steam outlet, the pipe inlets being so arranged in the steam generator that the pipe with the least immersion depth is supplied by overflow with water first and each successively more deeply immersed pipe is successively supplied with water by overflow with the most deeply immersed pipe supplied last.

2. A heat accumulator, according to claim 1 wherein said container is steel surrounded by a square cast iron block.

3. A heat accumulator according to claim 1, wherein said means for supplying heat to the accumulator medium is at least one electrical heating element external to said accumulator medium.

4. A heating system including the combination of several heat accumulator units according to claim 1 in which the steam outlets of several steam generators are connected by a common steam pipe to heat utilization means serially connected to a common condensate reservoir, which reservoir is coupled to means for feeding water to the respective steam generators.

5. A heating system according to claim 4, wherein a check valve is fitted to the condensate reservoir so that the plant can be operated in a vacuum steam mode.

6. A heating system according to claim 4 wherein the system is closed and operates at a steam pressure in excess of atmospheric pressure.

7. A heating system according to claim 4, wherein the condensate reservoir is open to the atmosphere and the system operates with steam at atmospheric pressure.

8. A heating system including at least one heat accumulator unit according to claim 1, the steam generator of each of said at least one heat accumulator unit having its steam outlet connected by a steam pipe to a steam utilization means, a condensate reservoir downstream of the steam utilization means for receiving condensate therefrom, and means for returning the condensate from the reservoir to the water inlet of the steam generator of each of said at least one heat accumulator unit.

9. A heating system according to claim 8, wherein said steam utilization means includes a heating system having a heat exchanger employing steam supplied by said steam pipe and a refrigeration plant driven by a steam turbine supplied with steam from said steam pipe and means for selectively supplying steam from said steam pipe to either said heater exchanger of said heating system or to said turbine of said refrigeration system.

* * * * *

UNITED STATES PATENT AND TRADEMARK OFFICE

CERTIFICATE OF CORRECTION

PATENT NO. : 4,071,079

DATED : January 31, 1978

INVENTOR(S) : Hans Engelbrecht

It is certified that error appears in the above-identified patent and that said Letters Patent are hereby corrected as shown below:

Col. 4, line 5, change "33" to ---35---.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*